US006281857B1

(12) United States Patent
Dobrovolny

(10) Patent No.: US 6,281,857 B1
(45) Date of Patent: Aug. 28, 2001

(54) DIPOLE UHF ANTENNA

(75) Inventor: Pierre Dobrovolny, North Riverside, IL (US)

(73) Assignee: Zenith Electronics Corporation, Lincolnshire, IL (US)

( * ) Notice: Subject to any disclaimer, the term of this patent is extended or adjusted under 35 U.S.C. 154(b) by 0 days.

(21) Appl. No.: 09/469,420

(22) Filed: Dec. 23, 1999

(51) Int. Cl.[7] ..... H01Q 9/28

(52) U.S. Cl. ..... 343/795; 343/752; 343/802; 343/804; 343/814

(58) Field of Search ..... 343/700 MS, 795, 343/820, 752, 793, 794, 799, 801, 802, 804, 810, 812, 813, 814, 816

(56) References Cited

U.S. PATENT DOCUMENTS 3,967,276 * 6/1976 Goubau ..... 343/795
4,160,980 * 7/1979 Murray ..... 343/795
4,870,426 * 9/1989 Lamberty et al. ..... 343/727
5,982,336 * 11/1999 Wen et al. ..... 343/793

* cited by examiner

*Primary Examiner*—Tho G Phan

(57) ABSTRACT

Indoor UHF antennas for HDTV and ATSC television signals each include a reflector backplate from which is supported one or more dipoles. Both passive and active antennas are disclosed. The active antennas include: single amplifier with a single dipole; push-pull amplifier with a single dipole; two amplifiers with two parallel dipoles; and two push-pull amplifiers with crossed dipoles. The dipole plates comprise printed circuit boards with the amplifiers directly deposited on the obverse sides of the dipole plates.

15 Claims, 3 Drawing Sheets

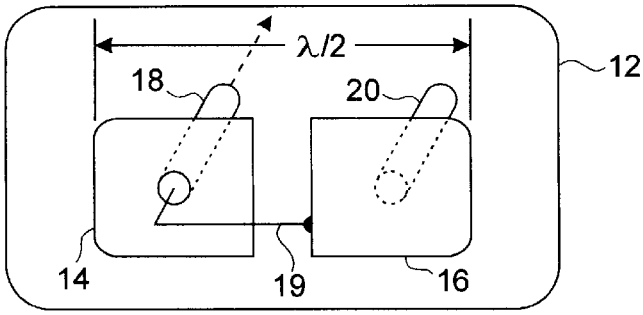
FIG. 1
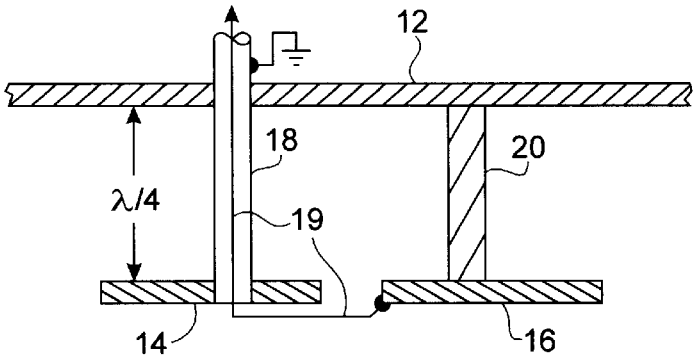
FIG. 2
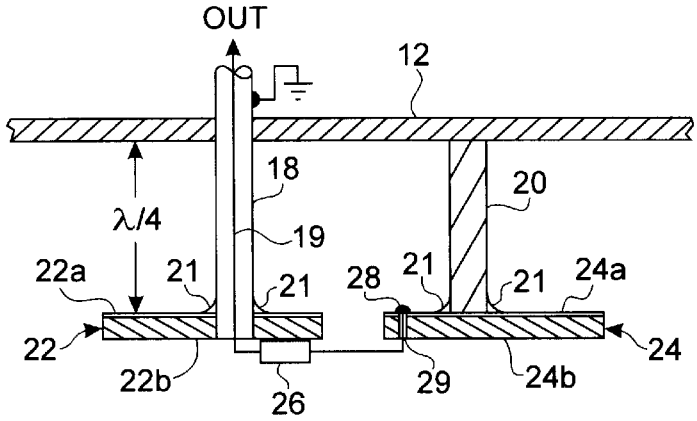
FIG. 3
FIG. 6
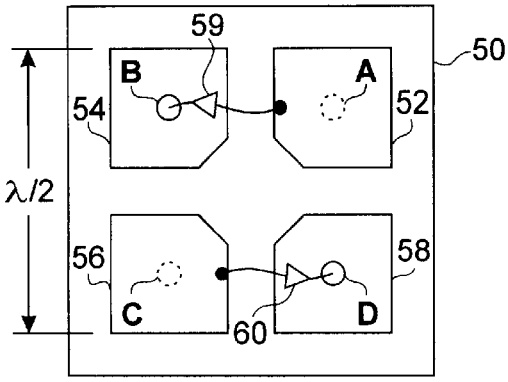
FIG. 7
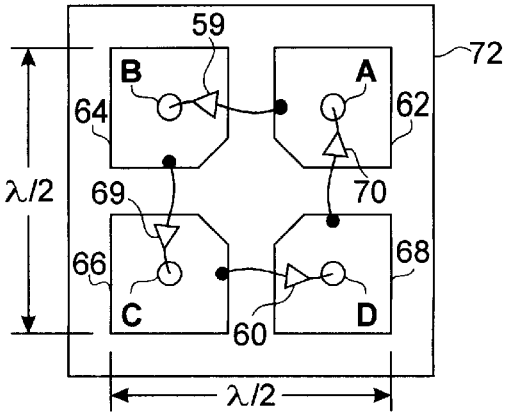

DIPOLE UHF ANTENNA

CROSS REFERENCE TO RELATED APPLICATION

This application is related to commonly assigned application Ser. No. 09/469,422, filed Dec. 23, 1999 entitled Combined UHF and VHF Antenna in the name of the inventor.

BACKGROUND OF THE INVENTION

This invention relates generally to UHF antennas and particularly to UHF antennas that are intended for indoor use. With the recent adoption of television signal transmission standards for HDTV (High definition television) signals and ATSC (Advanced television systems committee) type signals, the need for significantly improved UHF antennas, primarily for indoor use, has become apparent. Since the transmitted signals are digital, it is imperative that signal reception be optimized to prevent data corruption.

Conventional UHF indoor antennas are limited in gain and very sensitive to the direction and polarization of the received signals. In an analog environment, signal reflections and reduced gains were more tolerable in that the quality of the picture was compromised, but at least the viewer was presented with a compromised, but viewable picture. With digital signals, these same signal impairments most often result in no viewable picture. Further, the transmitted digital signals are of much lower power than their analog counterparts (to minimize interference into cochannel NTSC signals) and it is very important to maintain a high signal to noise ratio.

The UHF antennas of the invention include a reflecting backplate and an increased width/length ratio. The increased width/length ratio improves the wideband performance of the antenna, whereas the reflector guarantees a 10 to 15 dB front to back ratio in addition to providing excellent decoupling between the output cable and the dipole elements. Additionally, the dipole plates are supported by support stubs that maintain an approximate $\lambda/4$ distance between the reflector and the dipole elements. (Those skilled in the art will recognize that $\lambda$ is the free space wavelength of the UHF band center.) Both passive and active antennas are disclosed. The active antennas include amplifiers and may be oriented for vertically polarized signals, horizontally polarized signals or both such types of signals.

OBJECTS OF THE INVENTION

A principal object of the invention is to provide a novel indoor type UHF antenna.

Another object of the invention is to provide an improved indoor UHF antenna.

A further object of the invention is to provide an indoor UHF antenna system for reception of HDTV signals.

BRIEF DESCRIPTION OF THE DRAWINGS

These and other objects and advantages of the invention will be apparent upon reading the following description in conjunction with the drawings in which:

FIG. 1 is a simplified, diagrammatic, front view of a passive indoor single dipole UHF antenna constructed in accordance with the invention;

FIG. 2 is an enlarged cross sectional view of a portion of the antenna of FIG. 1;

FIG. 3 is an enlarged cross sectional view of an active, single amplifier, single dipole version of the antenna of FIG. 1;

FIG. 6 is a simplified, diagrammatic, front view of an active, two amplifier, two-dipole UHF antenna constructed in accordance with the invention;

FIG. 7 is a simplified, diagrammatic, front view of an active, four transistor (two push-pull amplifiers), two crossed dipoles UHF antenna constructed in accordance with the invention;

DETAILED DESCRIPTION OF THE INVENTION

Figure 4:
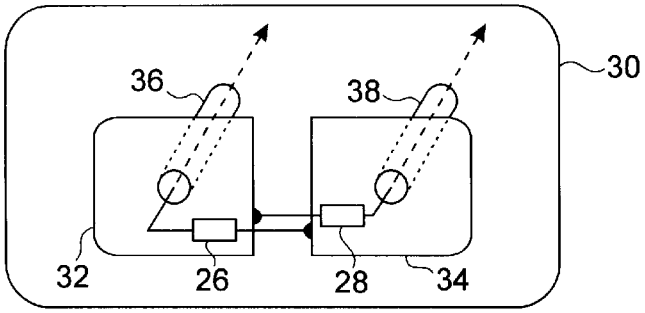
FIG. 4 is a simplified, diagrammatic front view of an active, push-pull amplifier, single dipole indoor UHF antenna.

Referring generally to FIGS. 1–3, both passive and active versions of a single dipole UHF antenna of the invention are shown. A generally rectangular-shaped, conductive backplate 12 serves as a reflector for UHF signals that are reflected to first and second conductive dipole plates 14 and 16, which are supported in spaced parallel relationship to the backplate by first and second conductive supports 18 and 20, respectively. The two conductive dipole plates 14,16 together form a dipole antenna. Support 18, for conductive plate 14, comprises a coaxial connection arrangement. This arrangement includes an insulated center conductor 19, which serves as the antenna output lead, and the outer, cylindrical conductive support 18, which is connected to local grounds on both ends. The center conductor 19 is connected to conductive plate 16 as best seen in FIG. 2.

The UHF antenna of FIGS. 1 and 2 is passive. The antenna has an increased width to length ratio, compared with prior art dipoles, which improves its wideband performance. The dipole length, as illustrated, is about $\lambda/2$, where $\lambda$ is the freespace wavelength of the UHF band center. The larger size of backplate 12 guarantees a 10 to 15 dB front to back ratio for the dipole and also provides for excellent decoupling between the antenna output cable (center conductor 19) and the dipole elements. Those skilled in the art will recognize that the backplate need not be of solid construction, but may consist, at least in substantial portion, of a dense wire mesh.

The conductive supports 18 and 20 maintain an approximate $\lambda/4$ distance between backplate 12 and the dipole elements, i.e., conductive plates 14,16. The supports and the dipole elements determine the average antenna impedance, which is close to 75 ohms for the passive implementation. The conductive support 16 may be solid or hollow, as dictated by the design environment Other, independent means of support may also be used. In this embodiment, conductive support 16 is both mechanically and electrically affixed between backplate 12 and conductive dipole plate 16.

In FIG. 3, an active version of the antenna is illustrated. In it, an amplifier 26 has its output connected to center conductor 19. The dipole elements 22 and 24 are constructed of printed circuit board material. The amplifier 26 is preferably laid out directly on the surface 22*b* of dipole plate 22, with all of the essential ground connections (not shown) deposited on surface 22*a*. The inner surface 22*a* is electrically connected to the outer cylindrical surface of conductive support 18, for example, by solder filets 21. The input of amplifier 26 is electrically connected to copper surface 24*a* of dipole plate 24 by means of a suitable eyelet (or plated-through hole) 29. The direct integration of the amplifier with the antenna plate gives better results in terms of matching and noise figure over the arrangement where the amplifier is simply added to the antenna output cable. It will be appreciated that a solid connection such as an eyelet or a plated-through hole is preferred, but any other acceptable production technique may be used provided that caution is exercised to minimize stray inductor in the amplifier input path.

Figure 5:
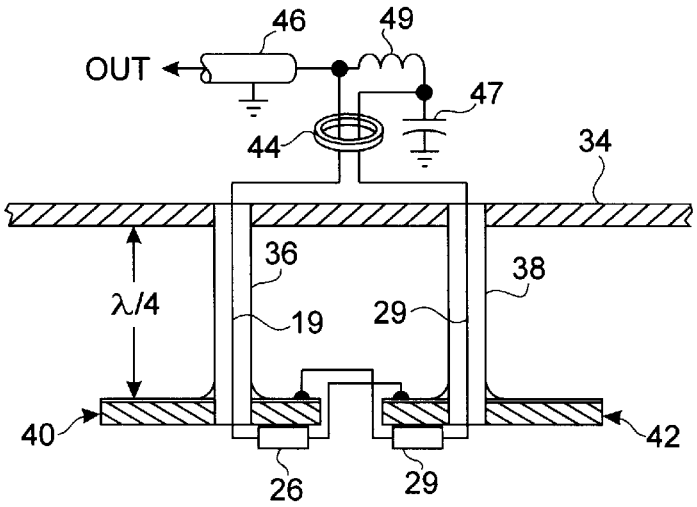
FIG. 5 is an enlarged cross sectional view of the active push-pull amplifier, single dipole version of the antenna of FIG. 4 with the addition of some output components.

FIGS. 4 and 5 illustrate active versions of the UHF antenna that have single dipoles and two transistors, forming a push-pull arrangement, to improve the nonlinear antenna performance. The arrangement is substantially like those discussed above, except that both supports comprise coaxial connections and a second amplifier is deposited on the other dipole plate. Thus, backplate 34 has hollow conductive supports 36 and 38 supporting dipole conductive plates 40 and 42 therefrom at the specified $\lambda/4$ distance. The second amplifier 28, which has all of the essential ground connections made on surface 42, has its input connected to the inner surface of dipole plate 40 and its output connected to center conductor 29, which along with center conductor 19, is connected to one side of a balun 44. On the other side of balun 44 one conductor is RF bypassed to ground by a capacitor 47 and the other conductor is connected to a coaxial cable 46, which comprises the antenna output. A choke 49 is connected across this side of balun 44 for supplying DC power to amplifier 28. The push-pull arrangement of the transistor amplifiers primarily improves the second order intermodulation distortion. It will be appreciated that the transistor amplifiers are assumed to be matched and to have feedback and therefore exhibit good symmetry, which is necessary for even order product cancellation. The input circuits of the transistor amplifiers are in parallel and they are supplied with opposite polarity input signals. The outputs of the amplifiers are connected in series. Balun 44 is wound with bifilar wire on a ferrite core and provides the necessary common mode suppression between its input and its output.

FIGS. 6 and 7 illustrate different versions of active antennas, one with two amplifiers (each comprising a transistor, not shown) and two parallel dipoles, and the other with two push-pull amplifiers (four transistors, not shown) and two crossed dipoles. In FIG. 6, two identical dipoles (conductive plates 52,54 and 56,58), each like that in the FIG. 3 implementation, have a common reflector backplate 50, from which the dipoles are mounted with an overall vertical center separation of about $\lambda/2$. Here again, the dipole plates are preferably constructed of printed circuit board material with suitable deposited conductive areas on the other sides and plated-through holes or eyelets, as required. The increased directivity obtained, mainly in the vertical direction, as will be seen if FIG. 8, improves both the gain and noise performance of the antenna. Amplifier 59 is mounted on the upper left dipole plate 54 and is connected between the center conductor of conductive coaxial support B (output) and upper right dipole plate 52 (input). Amplifier 60 is mounted on the lower right dipole plate 58 and is connected between the center conductor of conductive coaxial support D (output) and lower left dipole plate 56 (input). In this implementation, conductive supports A and C do not have center conductors.

In the FIG. 7 version, each amplifier 59, 60, 69 and 70 is mounted (preferably by direct deposition) on the dipole plates 64, 68, 66 and 62, respectively. The dipole plates are supported from reflecting backplate 72 by respective conductive supports, B, D, C and A, each of which includes an insulated center conductor to which one amplifier terminal is connected, with the other amplifier terminal being connected to its adjacent dipole plate in a "daisy chain" fashion. This arrangement provides diversity for receiving differently polarized signals, as will be seen with reference to FIG. 9.

Figure 8:
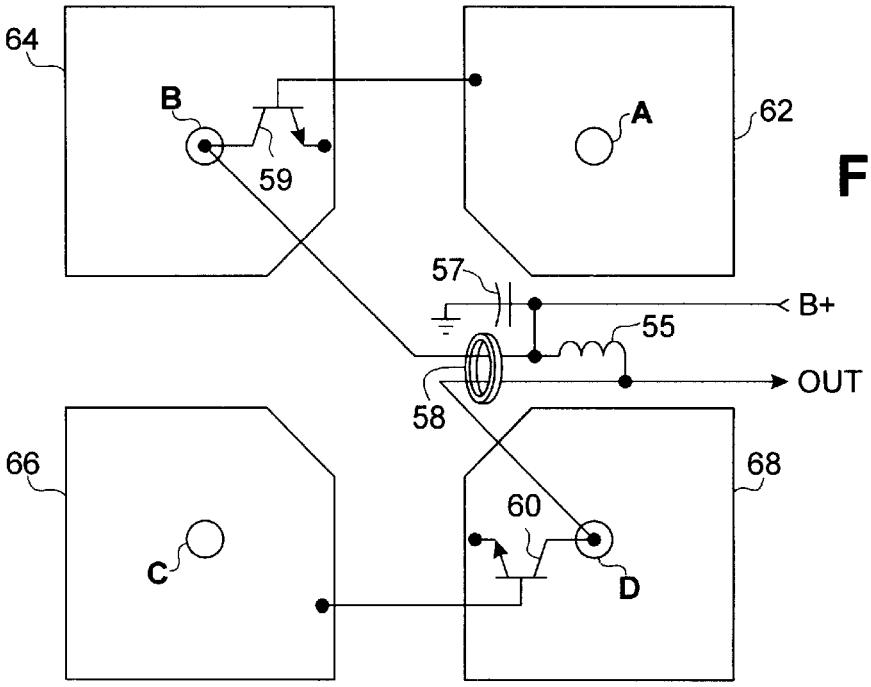
FIG. 8 illustrates the electrical connection arrangement of the antenna of FIG. 6.

The diagram of FIG. 8 shows the interconnection of the center conductors of supports B and D, amplifiers 59, and 60 and a balun 53. Balun 53 is coupled on one side to the center conductors of supports B and D and, on its other side, has a choke 55 connected across its leads, with one lead being RF-bypassed to ground through a capacitor 57, and the other lead serving as the signal output. B+ is supplied to the amplifiers at the junction of choke 55 and capacitor 57, as illustrated, or it may be supplied through a cable connected to the output. In this arrangement, the amplifiers operate in push-pull to combine the out-of-phase signals (propagating in the horizontal plane) from the upper and lower set of dipole plates.

Figure 9:
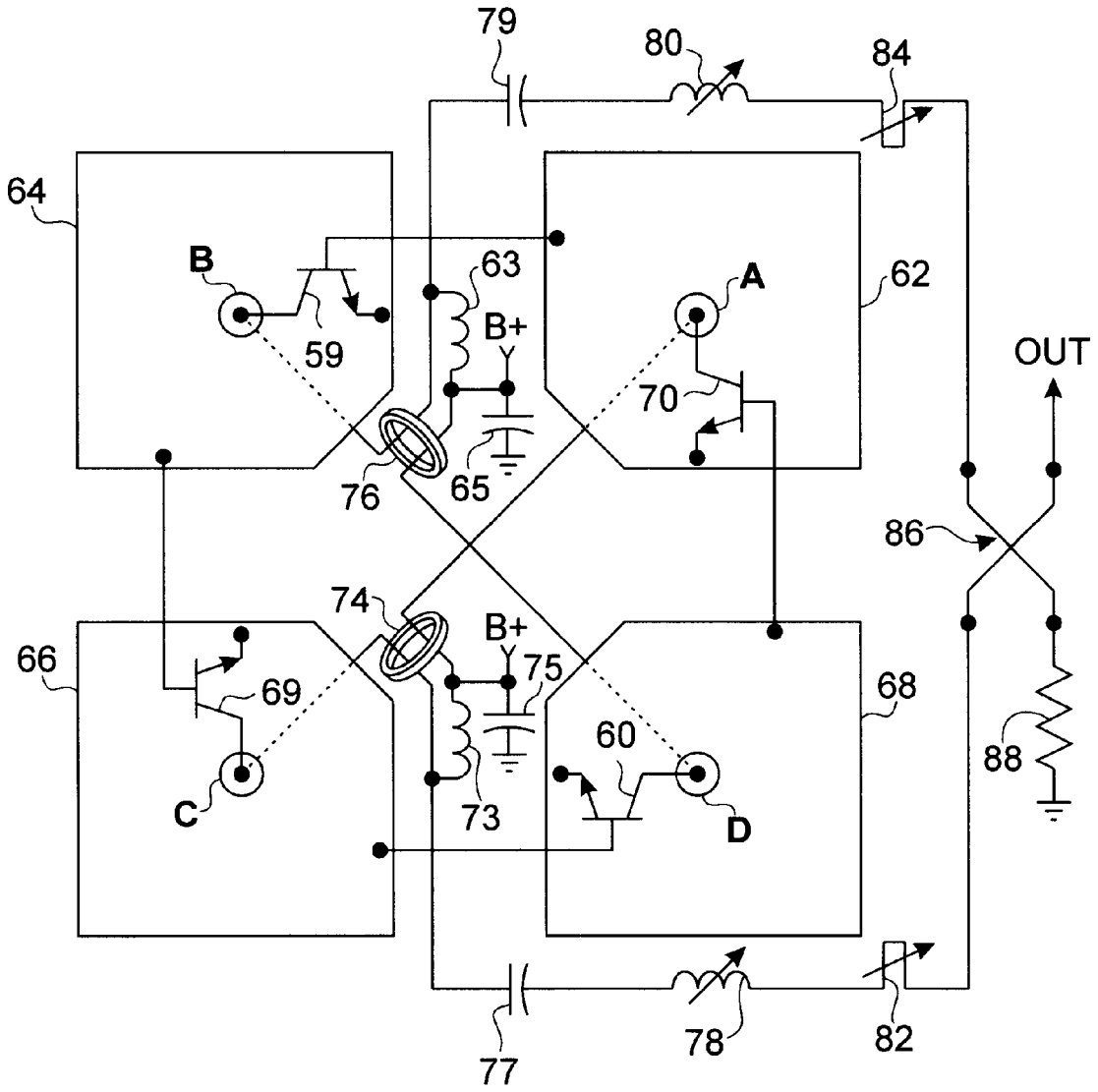
FIG. 9 illustrates the electrical connection arrangement of the antenna of FIG. 7.

The diagram of FIG. 9 shows the interconnection of the center conductors of supports A, B, C and D, amplifiers 59, 69, 60 and 70, baluns 74 and 76, capacitors 77 and 79, variable attenuators 78 and 80, variable phase elements 82 and 84, a 3 dB hybrid coupler 86 and a resistor 88. Also illustrated are chokes 63 and 73 and RF bypass capacitors 65 and 75 for supplying B+ to the amplifiers and developing output signals. This arrangement provides great flexibility in determining polarization diversity and/or suppression of any one interfering polarization of signal. In the arrangement illustrated, dipole plates 62 and 64 form the upper part of a vertical dipole and dipole plates 66 and 68 form the lower part of the vertical dipole. Amplifiers 69 and 70 process the signal from this vertical dipole. On the other hand, dipole plates 62 and 68 form the right part of a horizontal dipole and dipole plates 64 and 66 form its left part. Amplifiers 59 and 60 process the signal from this horizontal dipole. By adjustment of the attenuators and phase elements, the antenna may be adjusted to receive or to cancel:

1. Linearly polarized signals in any direction;
2. Right-hand circularly polarized signals;
3. Left-hand circularly polarized signals; and
4. Elliptical, with main axis in any direction and any axial ratio.

What has been described are novel indoor UHF antennas that provide improved reception for HDTV and ATSC television signals. It is recognized that numerous changes to the described embodiments of the invention will be apparent to those skilled in the art without departing from its true spirit and scope. The invention is to be limited only as defined in the claims.

What is claimed is:

1. A dipole UHF antenna comprising:

a reflector;

a first conductive support and a second conductive support;

said first conductive support and said second conductive support each being mechanically and electrically affixed to said reflector;

a first conductive plate and a second conductive plate;

said first conductive plate and said second conductive plate, each being mechanically and electrically affixed to said first conductive support and said second conductive support, respectively, and being supported therefrom in a spaced parallel relationship with said reflector;

said first conductive support comprising a coaxial cable having a center conductor and an outer conductive sheath; and a connection from said center conductor to said second conductive plate.

2. The dipole antenna of claim 1, wherein said first conductive plate and said second conductive plate have a length of substantially $\lambda/2$, where $\lambda$ is the free space wavelength of the UHF band center.

3. The dipole antenna of claim 2, wherein said reflector is larger than said conductive plates.

4. The dipole antenna of claim 2, wherein said first conductive support and said second conductive support cooperate to support said conductive plates at a distance of substantially $\lambda/4$ from said reflector.

5. An active UHF dipole antenna comprising:

a reflector;

a first conductive support and a second conductive support;

said first conductive support and said second conductive support each being mechanically and electrically affixed to said reflector;

a first conductive plate and a second conductive plate;

said first conductive plate and said second conductive plate, each being mechanically and electrically affixed to said first conductive support and said second conductive support, respectively, and being supported therefrom in a spaced parallel relationship with said reflector;

said first conductive support comprising a first coaxial member having a first center conductor and a first outer conductive sheath; and a first amplifier connected between said first center conductor and said second conductive plate.

6. The dipole antenna of claim 5, wherein said first conductive plate and said second conductive plate each comprise a printed circuit board and wherein said first amplifier is located on one of said first conductive plate and said second conductive plate.

7. The dipole antenna of claim 6 wherein:

said first conductive plate and said second conductive plate have a length of substantially $\lambda/2$, where $\lambda$ is the free space wavelength of the UHF band center;

said reflector is larger in size than said conductive plates; and said first conductive support and said second conductive support cooperate to support said first conductive plate and said second conductive plate at a distance substantially $\lambda/4$ from said reflector.

8. The dipole antenna of claim 7, wherein said second conductive support comprises a second coaxial member having a second center conductor and a second outer conductive sheath and further comprising:

a second amplifier connected between said second center conductor and said first conductive plate.

9. The dipole antenna of claim 8, wherein said second amplifier is located on the other of said first conductive plate and said second conductive plate.

10. An active UHF dipole antenna comprising:

a reflector;

four conductive supports mechanically and electrically affixed to said reflector;

four conductive plates mechanically and electrically affixed to said four conductive supports, respectively, all of said conductive plates being supported in a spaced parallel relationship with said reflector;

two of said conductive supports comprising coaxial members having insulated center conductors and outer conductive sheaths in electrical contact with their respective conductive plates; and a pair of amplifiers connected between said center conductors and the remaining two of said conductive plates.

11. The dipole antenna of claim 10, wherein said conductive plates each comprise a printed circuit board and wherein said amplifiers are located on a corresponding pair of said conductive plates.

12. The dipole antenna of claim 11, wherein pairs of said conductive plates each have a length of substantially $\lambda/2$, where $\lambda$ is the free space wavelength of the UHF band center;

said reflector is larger in size than said pairs of conductive plates; and said conductive supports cooperate to support said pairs of conductive plates at a distance of substantially $\lambda/4$ from said reflector.

13. The dipole antenna of claim 12, wherein said pairs of conductive plates and said amplifiers are arranged for preferential response to horizontally polarized signals.

14. The dipole antenna of claim 13, wherein all of said conductive supports comprise coaxial members having insulated center conductors and outer conductive sheaths electrically coupled to said conductive plates and further comprising:

another pair of amplifiers, each of all four of said amplifiers being connected between a center conductor and a conductive plate in a daisy chain fashion to receive both horizontally and vertically polarized signals.

15. The dipole antenna of claim 14, wherein each of said amplifiers is located on a different one of said conductive plates.

* * * * *